US008439327B2

(12) United States Patent
Hall et al.

(10) Patent No.: US 8,439,327 B2
(45) Date of Patent: May 14, 2013

(54) SHEAR BLOCK AND BLADE INTERFACE AND METHOD

(75) Inventors: Christopher A. Hall, Cypress, TX (US); Seemant Yadav, Houston, TX (US); John G. Landthrip, Katy, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 601 days.

(21) Appl. No.: 12/643,308

(22) Filed: Dec. 21, 2009

(65) Prior Publication Data

US 2011/0147623 A1 Jun. 23, 2011

(51) Int. Cl.
*E21B 33/06* (2006.01)

(52) U.S. Cl.
USPC ..... 251/1.3; 251/1.1

(58) Field of Classification Search ..... 251/1.3, 251/1.1
See application file for complete search history.

(56) References Cited

U.S. PATENT DOCUMENTS 2,919,111 A * 12/1959 Nicolson ..... 166/352
3,736,982 A * 6/1973 Vujasinovic ..... 166/55
3,817,326 A * 6/1974 Meynier, III ..... 166/55
4,240,503 A * 12/1980 Holt et al. ..... 166/55
4,341,264 A * 7/1982 Cox et al. ..... 166/55
4,540,046 A * 9/1985 Granger et al. ..... 166/55
4,646,825 A * 3/1987 Van Winkle ..... 166/55
5,400,857 A * 3/1995 Whitby et al. ..... 166/297
5,713,581 A * 2/1998 Carlson et al. ..... 277/325
6,244,336 B1 * 6/2001 Kachich ..... 166/55
6,969,042 B2 * 11/2005 Gaydos ..... 251/1.3
7,195,224 B2 * 3/2007 Le ..... 251/1.3
7,207,382 B2 * 4/2007 Schaeper ..... 166/55
7,367,396 B2 * 5/2008 Springett et al. ..... 166/298

* cited by examiner

*Primary Examiner* — John K Fristoe, Jr.
*Assistant Examiner* — Andrew J Rost
(74) *Attorney, Agent, or Firm* — Bracewell & Giuliani LLP

(57) ABSTRACT

A blowout preventer having a first elongated cavity extending along a first axis and a second elongated cavity extending perpendicular to and intersecting the first elongated cavity, a shear block provided in the first elongated cavity and configured to slide along the first axis, where the shear block has a frontal face facing the second elongated cavity and configured to slide towards the second elongated cavity; and a shear blade configured to be attached to the shear block and also configured to shear a tool provided in the second cavity when the shear block slides towards the tool. The frontal face of the shear block has at least a pin region configured to enter a tail region of the shear blade such that the pin region and the tail region form a dovetail joint or the shear block has the tail region and the shear block has the pin region.

20 Claims, 7 Drawing Sheets

SHEAR BLOCK AND BLADE INTERFACE AND METHOD

BACKGROUND

1. Technical Field

Embodiments of the subject matter disclosed herein generally relate to methods and systems and, more particularly, to mechanisms and techniques for connecting a shear blade to a shear block.

2. Discussion of the Background

During the past years, with the increase in price of fossil fuels, the interest in developing new production fields has dramatically increased. At the same time, the equipment for extracting the oil is undergoing continuous changes for becoming more effective and reliable. Due to the high price of fossil fuels, a downtime of a rig for maintenance purposes needs to be reduced. However, it is know that, for example, for opening a shear ram blowout preventer (BOP) and changing the shear blades requires the effort of a few technicians for a few hours. One of the operations that is slowing down the shear blades replacements is, among others, the need to remove large screws connecting the shear blades to corresponding shear blocks.

Such a shear ram BOP is shown in FIG. 1. A BOP 16 is shown having shear blocks 20. The shear blocks 20 are configured to move, when actuated by a rod 22, inside a first elongated cavity 24. The first elongated cavity 24 extends along a first axis X. A second elongated cavity 26 extends substantially perpendicular to and intersects the first elongated cavity 24. The shear block 20 may include a shear blade 28 that is configured to cut a tool 30 that may be present inside a well 32. The shear blade 28 may have a sharp edge that effectively cuts tool 30 when necessary. A similar shear block and shear blade may be provided in an opposite region of the first elongated cavity 24.

A more detailed view of the shear block 20 and the shear blade 28 is shown in FIG. 2. The shear blade 28 is shown detached from the shear block 20. To attach the shear blade 28 to the shear block 20, a plurality of screws 36 are used. Corresponding holes 38 are formed in a frontal face 40 of the shear block 20. The sharp edge 42 of the shear blade 28 is configured to shear the tool. The thicker the tools provided inside well 32, the more powerful shear blocks 20 and blades 28 need to be provided to resist to the high pressures present inside the BOP when cutting the tool. Such pressure may be between 2,000 and 25,000 psi. However, the holes in the shear blade and the shear block weaken the structure of these elements, making them prone to failure when the high pressures are present.

Accordingly, it would be desirable to provide systems and methods that avoid the afore-described problems and drawbacks.

SUMMARY

According to one exemplary embodiment, there is a shear blowout preventer. The blowout preventer includes a first elongated cavity extending along a first axis and a second elongated cavity extending perpendicular to and intersecting the first elongated cavity; a shear block provided in the first elongated cavity and configured to slide along the first axis, where the shear block has side faces facing the first elongated cavity and a frontal face facing the second elongated cavity and the frontal face is configured to slide towards the second elongated cavity; and a shear blade configured to be attached to the shear block and also configured to shear a tool provided in the second elongated cavity when the shear block slides towards the tool. The frontal face of the shear block has at least a pin region configured to enter a tail region of the shear blade such that the pin region and the tail region form a dovetail joint or the shear block has the tail region and the shear blade has the pin region, and the shear blade has the tail region or the pin region on a rear face and a cutting edge on a frontal face, the frontal face being opposite to the rear face.

According to another exemplary embodiment, there is a shear mechanism to be used in a shear ram blowout preventer (BOP). The shear mechanism includes a shear block provided in a first elongated cavity of the BOP and configured to slide along the first elongated cavity, the shear block has side faces facing the first elongated cavity and a frontal face facing a second elongated cavity in the BOP that is substantially perpendicular to the first elongated cavity, and the frontal face is configured to slide towards the second elongated cavity; and a shear blade configured to be attached to the shear block and also configured to shear a tool provided in the second elongated cavity when the shear block slides towards the tool. The frontal face of the shear block has at least a pin region configured to enter a tail region of the shear blade such that the pin region and the tail region form a dovetail joint or the shear block has the tail region and the shear blade has the pin region, and the shear blade has the tail region or the pin region on a rear face and a cutting edge on a frontal face, the frontal face being opposite to the rear face.

According to yet another exemplary embodiment, there is a method for attaching a shear blade to a shear block in a shear blowout preventer (BOP). The method includes a step of positioning a shear block in a first elongated cavity of the BOP, the shear block having side faces facing the first elongated cavity and a frontal face facing a second elongated cavity in the BOP that is substantially perpendicular to the first elongated cavity, and the frontal face is configured to slide towards the second elongated cavity; and a step of sliding a shear blade on the shear block, the shear blade being configured to shear a tool provided in the second elongated cavity when the shear block slides towards the tool. The frontal face of the shear block has at least a pin region configured to enter a tail region of the shear blade such that the pin region and the tail region form a dovetail joint or the shear block has the tail region and the shear blade has the pin region, and the shear blade has the tail region or the pin region on a rear face and a cutting edge on a frontal face, the frontal face being opposite to the rear face.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of shear ram BOP systems. However, the embodiments to be discussed next are not limited to these systems, but may be applied to other systems that require withstanding high pressures.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a shear blade may be attached to a shear block in a BOP in a boltless manner, i.e., by using an interface that does not requires bolts, screws or other similar attaching devices. Alternatively, the novel interface allows the structural integrity of the shear block and the shear blade to be preserved as no large holes are formed in these two structures for attaching them one to the other.

Figure 1:
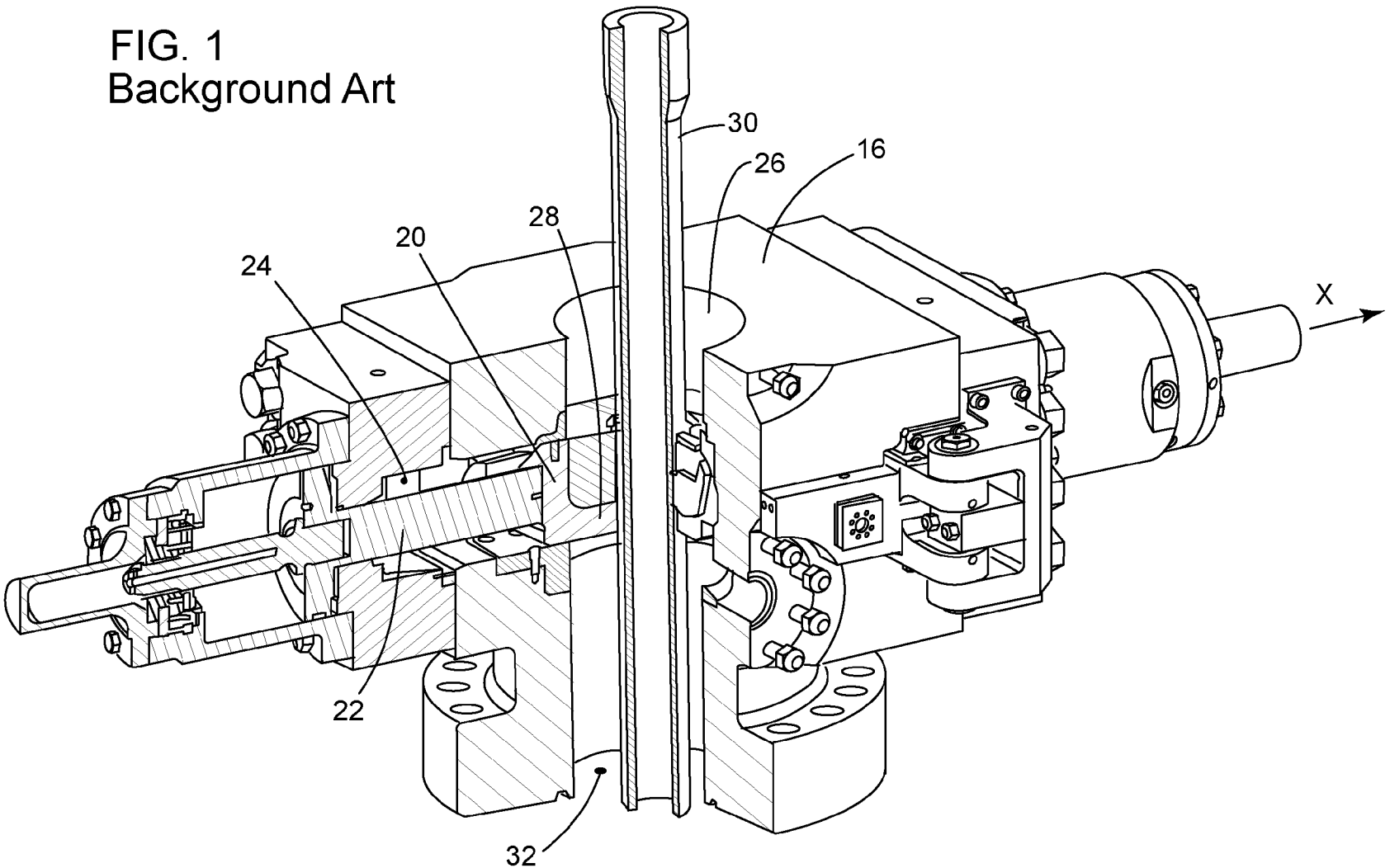
FIG. 1 Background Art
FIG. 1 is a schematic diagram of a conventional blowout preventer.
Figure 2:
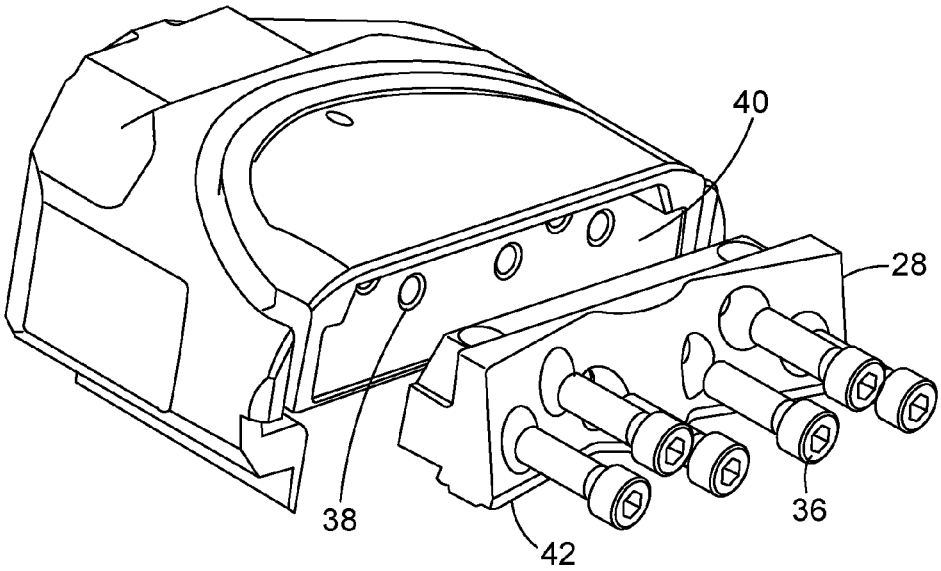
FIG. 2 Background Art
FIG. 2 is a schematic diagram of a shear block and a shear blade of a conventional blowout preventer.
Figure 3:
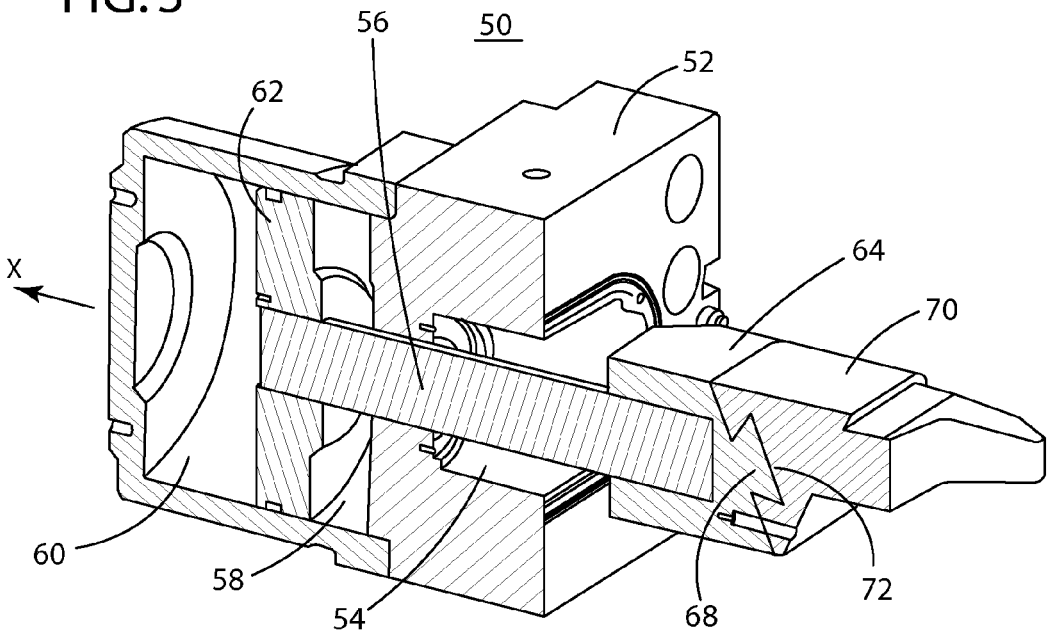
FIG. 3 is a schematic diagram of a shear blowout preventer according to an exemplary embodiment.

According to an exemplary embodiment shown in FIG. 3, a novel BOP 50 includes a body 52 having a first elongated cavity 54 that extends along a first axis X. The body 52 is configured to allow a rod 56 to enter an opening chamber 58 and a closing chamber 60. A piston 62 is attached to the rod 56 and by applying an appropriate pressure to the closing chamber 60 or the opening chamber 58, the piston 62, rod 56 and a shear block 64 attached to the rod 56 are moved in a desired direction along axis X.

Figure 5:
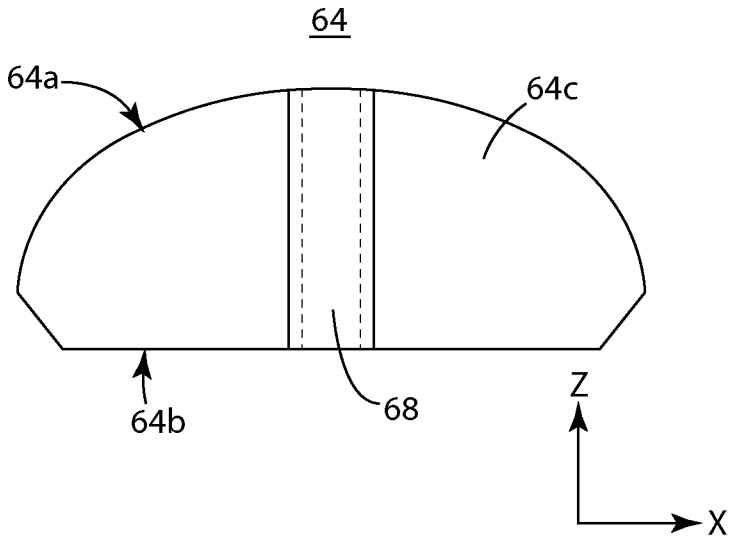
FIG. 5 is a schematic diagram of a shear block according to an exemplary embodiment.
Figure 6:
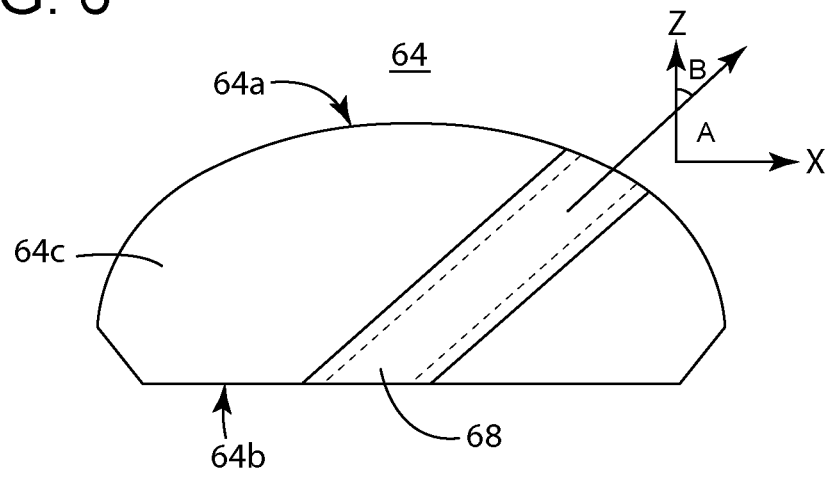
FIG. 6 is a schematic diagram of a shear block according to another exemplary embodiment.
Figure 7:
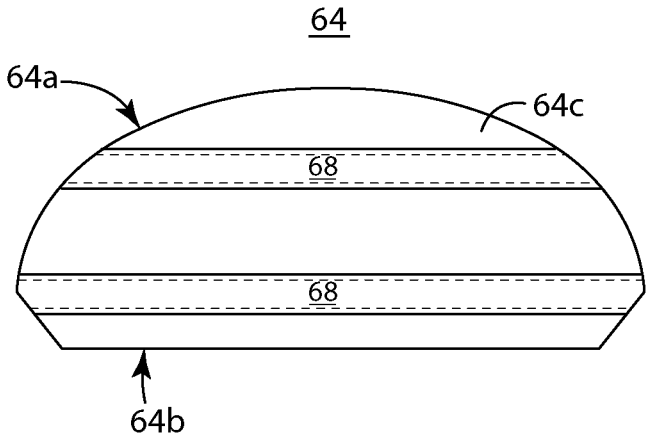
FIG. 7 is a schematic diagram of another shear block according to an exemplary embodiment.

The shear block 64 is attached to the rod 56 as is known by those skilled in the art. The shear block 64 is shown in more details in FIG. 4. The shear block 64 has side surfaces 64*a* and 64*b*, which are opposite to each other. First side surface 64*a* may have a larger area than a second side surface 64*b*. In one application, the first side surface 64*a* has a smaller area than the second side surface 64*b*. The shear block 64 has a front face 64*c* and a rear face 64*d*. The front face 64*c* includes a pin region 68 that may extend a second axis Y. The pin region 68 may also extend along another direction along face 64*c* of the shear block 64, as shown, for example, in FIGS. 5 and 6. More specifically, FIG. 6 shows that an angle B between a longitudinal axis A of the pin region 68 and a second axis Z extending along the second cavity of the BOP 50 may be different than 90 degrees. In one application, angle B is 80 degrees or less. According to another exemplary embodiment, two or more pin regions 68 may be formed on the front face 64*c* as shown in FIG. 7.

Figure 4:
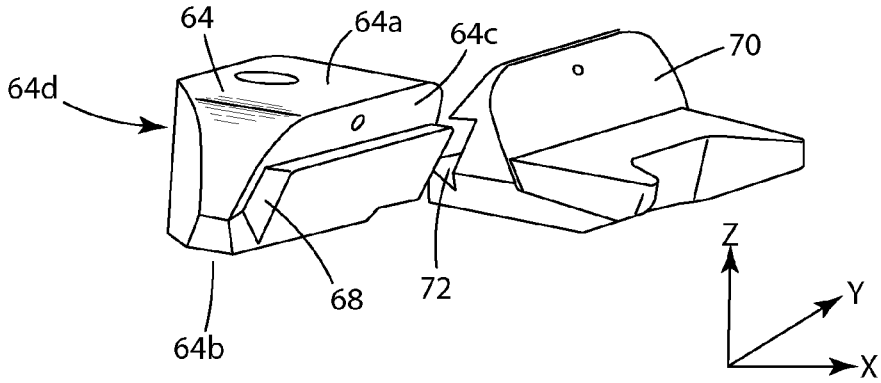
FIG. 4 is a schematic diagram of a shear block and a shear blade according to an exemplary embodiment.
Figure 8:
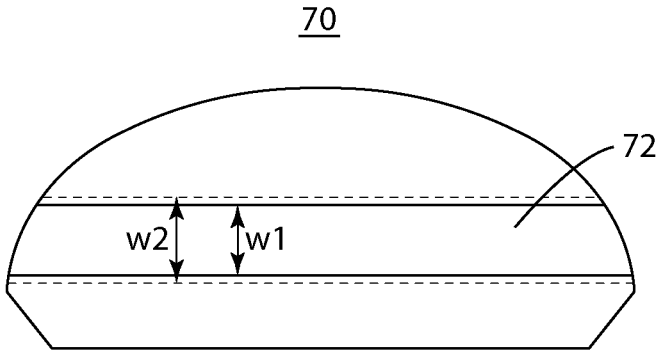
FIG. 8 is a schematic diagram of a shear blade according to an exemplary embodiment.
Figure 9:
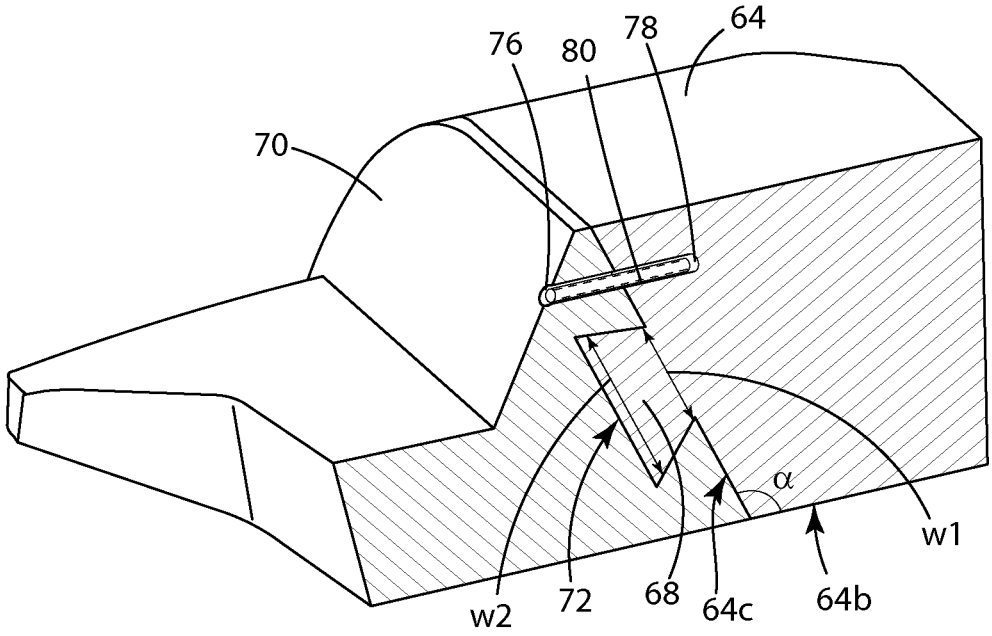
FIG. 9 is schematic diagram of a shear blade attached to a share block according to an exemplary embodiment.

For each pin region 68 on the shear block 64, there is a corresponding tail region 72 formed on the shear blade 70 shown in FIGS. 3 and 4. Alternatively, the pin region 68 may be formed on the shear blade 70 and the tail region 72 may be formed on the shear block 64. The tail region 72 is shown in more details in FIG. 8, in which the shape of the tail region is such that a first width w1 of the tail region 72 is larger than a second width w2 of the tail region 72, where the first width is measured at a distal end of the tail region and the second width is measured at a proximal end of the tail region. The widths w1 and w2 of the tail region 72 are also shown in FIG. 9. It is noted that these sizes are reversed for the pin region 68, i.e., a width of the distal end is w2 and a width of the proximal end is w1. FIG. 9 also shows an angle $\alpha$ between the side surface 64*b* and the frontal face 64*c*. Angle $\alpha$ may be between 30 degrees and minus 30 degrees.

FIG. 9 further shows a hole 76 formed in the shear blade 70 and a corresponding hole 78 formed in the shear block 64. A bolt or screw 80 may be provided through the hole 76 into the hole 78 to fix the shear blade 70 relative to the shear block 64. In one application, a cross section through the pin region 68 and a cross section through the tail portion 72 is trapezoidal as shown in FIG. 9. Other shapes are also possible. It is noted that holes 76 and 78 do not have to be large as the screw provided inside these holes is for preventing a sliding motion of the shear blade 70 relative to the shear block 64 and not for withstanding large forces that are present when the shear blade 70 shears a tool. For the same reason, only one bolt 80 may be used to fix the shear blade 70 to the shear block 64. In this regard it is noted that a traditional shear blade needs more than one bolt.

Figure 10:
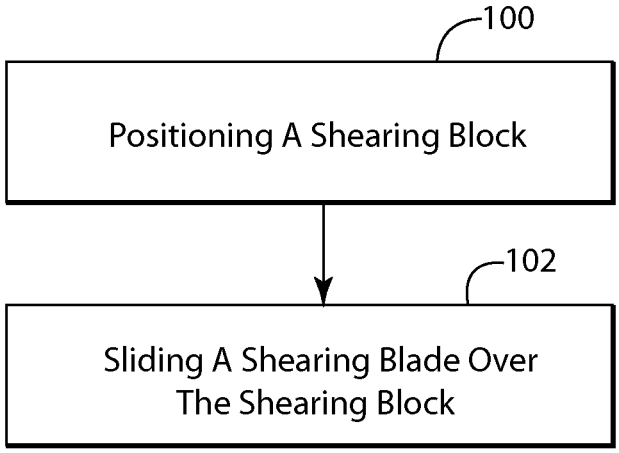
FIG. 10 is a flow chart illustrating a method for attaching a share blade to a share block according to an exemplary embodiment.

According to an exemplary embodiment illustrated in FIG. 10, there is a method for attaching a shear blade to a shear block in a blowout preventer. The method includes a step 100 of positioning a shear block in a first elongated cavity of the BOP, where the shear block has side faces facing the first elongated cavity and a frontal face facing a second elongated cavity in the BOP that is substantially perpendicular to the first elongated cavity, and the frontal face is configured to enter the second elongated cavity; and a step 102 of sliding a shear blade on the shear block, the shear blade being configured to shear a tool provided in the second elongated cavity when the shear block moves towards the tool. The frontal face of the shear block has at least a pin region configured to enter a tail region of the shear blade such that the pin region and the tail region form a dovetail joint, and the shear blade has the tail region on a rear face and a cutting edge on a frontal face, the frontal face being opposite to the rear face.

The disclosed exemplary embodiments provide a system and a method for reducing a time necessary for attaching/detaching a shear blade to a shear block. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A shear blowout preventer (BOP), comprising:

a body having a horizontal elongated cavity extending along a horizontal axis and a vertical elongated cavity extending perpendicular to and intersecting the horizontal elongated cavity;

a shear block provided in the horizontal elongated cavity and configured to slide along the horizontal axis, wherein the shear block has upper and lower surfaces and a frontal face facing the vertical elongated cavity and the frontal face is configured to slide towards the vertical elongated cavity;

a shear blade having a rear face attached to the frontal face of the shear block and configured to shear a tool provided in the vertical elongated cavity when the shear block slides towards the tool;

an elongated groove extending across one of the faces, the groove having opposite edges defining a face opening at said one of the faces, an inclined wall extending from each of the edges into said one of the faces, the inclined walls diverging from each other from the face opening to a base of the groove, defining a dovetail configuration; and a pin member protruding from the other of the faces, the pin member having a configuration that mates with the elongated groove to retain the shear blade on the shear block.

2. The shear BOP of claim 1, wherein the frontal face of the shear block is at an acute angle relative to a vertical plane, and the base of the groove is in a plane parallel to the frontal face.

3. The shear BOP of claim 1, wherein the groove is located in the rear face of the shear blade.

4. The shear BOP of claim 1, wherein the groove extends between lateral sides of said one of the faces and has an opening at one of the lateral sides to enable the pin member to slide into the groove.

5. The shear BOP of claim 1, wherein the groove has one end elevated relative to another end.

6. The shear BOP of claim 1, further comprising: a connecting element configured to enter through a hole in the shear blade into a corresponding hole in the shear block to prevent the pin member from sliding along the groove.

7. The shear BOP of claim 1, wherein each of the inclined walls is flat and located in a plane that is at an acute angle relative to a plane containing the base of the groove.

8. The shear BOP of claim 1, wherein the upper surface of the shear block has a different area from the lower surface of the shear block.

9. The shear BOP of claim 1, further comprising: another groove on said one of the faces extending parallel to said first mentioned groove.

10. A shear mechanism to be used in a shear ram blowout preventer (BOP), the shear mechanism comprising:

a shear/ram block provided in a horizontally extending cavity of the BOP and configured to slide along the horizontally extending cavity, wherein the shear/ram block has upper and lower surfaces, opposite lateral sides, and a frontal face facing a vertically extending cavity in the BOP, and the frontal face is configured to slide towards the vertically extending cavity;

a shear blade having a rear face configured to be attached to the frontal face of the shear/rain block and also configured to shear a tool provided in the vertically extending cavity when the shear block/ram slides towards the tool;

a straight elongated groove extending across one of the faces, the groove having opposite edges at said one of the faces, defining a face opening, and a recessed base that is in a plane parallel to a plane containing the face opening, the groove having an inclined wall extending from each of the edges to the base, the inclined walls diverging from each other from the face opening to the base, providing the base with a greater width than a distance between the opposite edges of the groove;

a pin member protruding from the other of the faces, the pin member having a configuration that mates with the elongated groove to retain the shear blade on the shear block;

the groove having an end opening into which the pin member slides to insert the pin member into the groove; and a threaded fastener extending through part of the shear blade into the shear/ram block to prevent sliding movement of the shear blade relative to the shear/ram block.

11. The shear mechanism of claim 10, wherein the frontal face of the shear/ram block is at an acute angle relative to vertical.

12. The shear mechanism of claim 10, wherein pin member is located on the frontal face of the shear/ram block.

13. The shear mechanism of claim 10, wherein the groove has one end at the upper surface of the shear/ram block and another end at the lower surface of the shear/ram block.

14. The shear mechanism of claim 10, wherein the groove extends at an inclination relative to horizontal.

15. The shear mechanism of claim 10, wherein the inclined walls of the groove are flat.

16. The shear mechanism of claim 10, wherein the base of the groove is flat and located in a plane inclined relative to vertical.

17. The shear mechanism of claim 10, wherein the upper surface of the shear/ram block has an area that differs from an area of the lower surface of the shear/ram block, the upper and lower surfaces being opposite to each other.

18. The shear mechanism of claim 10, further comprising:

another groove on said one of the faces parallel to and spaced form said first mentioned groove.

19. A method for attaching a shear blade to a shear block in a shear blowout preventer (BOP), the method comprising:

positioning a shear block in a horizontally extending cavity of the BOP, wherein the shear block has a frontal face facing a vertically extending cavity in the BOP, and the frontal face is configured to slide towards the vertically extending cavity;

providing a shear blade with a rear face that mates with the frontal face;

forming a groove in one of the faces, the groove having opposite edges at said one of the faces, defining a face opening, and a base recessed from the face opening, the groove having an inclined wall extending from each of the edges to the base, the inclined walls diverging from each other from the face opening to the base, providing the base with a greater width than a distance between the opposite edges of the groove, the groove having an end with an end opening;

forming a pin member on the other of the faces, the pin member having a configuration that mates with the elongated groove; and inserting one end of the pin member into the end opening and sliding the shear blade on the shear block.

20. The method of claim 19, further comprising: fixing the shear blade to the shear block with a bolt.

* * * * *